United States Patent [19]

Cahoon et al.

[11] Patent Number: 4,776,818

[45] Date of Patent: Oct. 11, 1988

[54] AUTOMATIC TRIM CONTROL SYSTEM FOR MULTIPLE DRIVE BOATS

[76] Inventors: William L. Cahoon; Gary D. Garbrecht, both of P.O. Box 69, Hwy. 27, Lake Hamilton, Fla. 33851

[21] Appl. No.: 946,536

[22] Filed: Dec. 24, 1986

[51] Int. Cl.[4] ..... B63H 5/08

[52] U.S. Cl. ..... 440/53; 440/61; 440/79

[58] Field of Search ..... 440/53, 61, 62, 1, 2, 440/900, 79, 80; 114/275, 285, 286; 60/420, 424; 91/171, 189 R, 361

[56] References Cited

U.S. PATENT DOCUMENTS

| | | | |
|---|---|---|---|
| 4,005,674 | 2/1977 | Davis | 440/2 |
| 4,220,004 | 9/1980 | Abeille et al. | 91/171 |
| 4,310,320 | 1/1982 | Pitchford | 440/61 |
| 4,354,595 | 10/1982 | Reynolds | 91/171 |

FOREIGN PATENT DOCUMENTS

| | | | |
|---|---|---|---|
| 931991 | 5/1982 | U.S.S.R. | 91/171 |

*Primary Examiner*—Sherman D. Basinger
*Assistant Examiner*—Edwin L. Swinehart
*Attorney, Agent, or Firm*—James H. Beusse

[57] ABSTRACT

An electrical control system is disclosed for trimming a pair of stern motors or drives mounted side-by-side on a boat. The two drives are both jointly and independently movable through a plurality of trim positions. The system includes two trim cylinders, each coupled to one associated drive, to move its associated drive to different trim positions both jointly as well as independently of each other. An operator controlled mechanism energizes and de-energizes the two trim cylinders simultaneously to jointly vary the trim position of the two drives. Two lines, each coupled at its first end to one associated drive, independently detects both the angular trim position of its associated drive with respect to the other drive as well as detects the trim position of the two drives jointly. Detection apparatus is coupled to the second end of each of the two lines and is responsive to the two lines when the two drives are not in the desired equal trim position with respect to each other for controlling switches to inactivate one of the trim cylinders and thereby moves the other of the trim cylinders with respect to the inactivated one trim cylinder until the desired equal trim position is achieved between the two drives.

8 Claims, 3 Drawing Sheets

B+
R+
UP
DOWN
A
B
C
150
152
154
152A
154A
134
136
160
162
164
166
168
170
172
174
176
178
180
182
184
186
184A
186A
188
190
192
194
196
198
200
202
204
206
208
210
212
214
216

AUTOMATIC TRIM CONTROL SYSTEM FOR MULTIPLE DRIVE BOATS

BACKGROUND OF THE INVENTION

1. Field of the Invention

This invention relates generally to multiple drive marine vessels and, more particularly, to control apparatus for adjusting and equalizing the angular trim position of plural outboard motors or other stern drives on boats.

2. Description of the Prior Art

Many techniques are known for individually tilting or trimming plural-outboard motors or other stern drives on boats to a desired angular trim position. The trimming of drives of boats is normally effected by an operator controlled, three position switch, i.e., up, down and off, which individually varies the trim or angular positioning of a drive during boat operation. Separate switches are usually provided for each drive. Each switch can also raise and lower the drives for clearance purposes. A dash mounted trim indicator may be read by the operator for determining the trim of a drive and, on a multiple drive boat, the switches may be read and compared for facilitating the equalization of the trim angle of the drives.

Trimming is carried out within a trim range defined by full down drive position and some higher trim limit position. Changes in the angle of propeller thrust can cause the boat bow to raise or lower and thus enables an operator to select a proper and more efficient angle for different loads or different water conditions or for operating the boat on plane. In addition, tilting or raising the drive or drives up past the trim range for clearance purposes enables safer running in shallow water and also facilitates launching or trailering. Note U.S. Pat. Nos. 3,434,449 and 3,641,965 for descriptions of various approaches to effecting trim.

In dual drive boats, two independent propulsion systems are utilized along with two independent trimming devices. While drive tilt systems generally move both drives simultaneously, the criticality of trim angles in high performance drives has generally required independent control of trim angles. After each occurrence of trim adjustment, the trim angle of each of the two drives will not necessarily be identical. A secondary trim adjustment of one of the drives must usually be made by the operator who is required to simultaneously observe and compare two dash mounted trim indicators in order to properly synchronize the trim of the two drives.

An example of the above described drive control system is disclosed in U.S. Pat. No. 4,310,320 to Pitchford. In Pitchford, a tie bar mechanically connects the housings of two stern drives and allows the drives to assume different trim positions within a trim limit range. Since damage can be incurred if the trim cylinders are operated independently to move one drive up or down for a substantial distance while the other drive remains stationary, outside the narrow trim range the control automatically moves the drives simultaneously. Within the trim range, the boat operator must still independently control and adjust the trim angle by monitoring trim indicators associated with each drive. Thus, while Pitchford provides conjoint movement for some tilt angles, the problem of trim adjustment for optimal performance while running has not been resolved and still requires operator intervention.

SUMMARY OF THE INVENTION

The present invention overcomes the disadvantages of the prior art by providing a system for automatic trim angle equalization of multiple drives. In an illustrative embodiment, there is described a system to independently equalize the trim position of two stern drives mounted on a boat wherein the two drives are both jointly and independently movable through a plurality of trim positions. The system includes at least two trim cylinders, each coupled to one associated drive, to move the associated drives to different trim positions both jointly as well as independently of each other. The system further includes operator controlled means to energize and de-energize the two trim cylinders simultaneously to jointly vary the trim position of the two drives. Two lines, each coupled at its respective first end to one associated drive, independently detect both the trim position of its associated drive with respect to the other drive and also detect the trim position of the two drives jointly. Automatic control means coupled to the second end of each of the two lines is responsive to the two lines, when the two drives are not in the desired equal trim position with respect to each other, to inactivate one of the trim cylinders and thereby move the other of the trim cylinders with respect to the inactivated one trim cylinder until the desired equal trim position is achieved between the two drives.

In one form, the automatic control system includes a block slideable in response to the joint movement of the lines. A pivot arm is rotatably mounted at its center on the block and movable therewith and one end of each line is attached to a corresponding end of the pivot arm. Switches are mounted on the block adjacent the pivot arm and are responsive to the rotation of the pivot arm caused by unequal movement of the lines resulting from a variation in the trim position between the drives to thereby inactivate an appropriate one of the trim cylinders until the drives are brought into the same equal trim position by the activated trim cylinder.

In another form, the automatic control system incorporates an electronic circuit for actuating the trim cylinders on each of a plurality of stern drives in response to a single trim angle command. Any difference in trim angle is electronically sensed and a selected one of the trim cylinders actuated to bring its associated drive into alignment with the other drive.

BRIEF DESCRIPTION OF THE DRAWINGS

For a more complete understanding of the nature, objects, and advantages of the present invention, reference should be had to the following detailed description taken in conjunction with the accompanying drawings wherein.

DETAILED DESCRIPTION OF THE INVENTION

Figure 1:
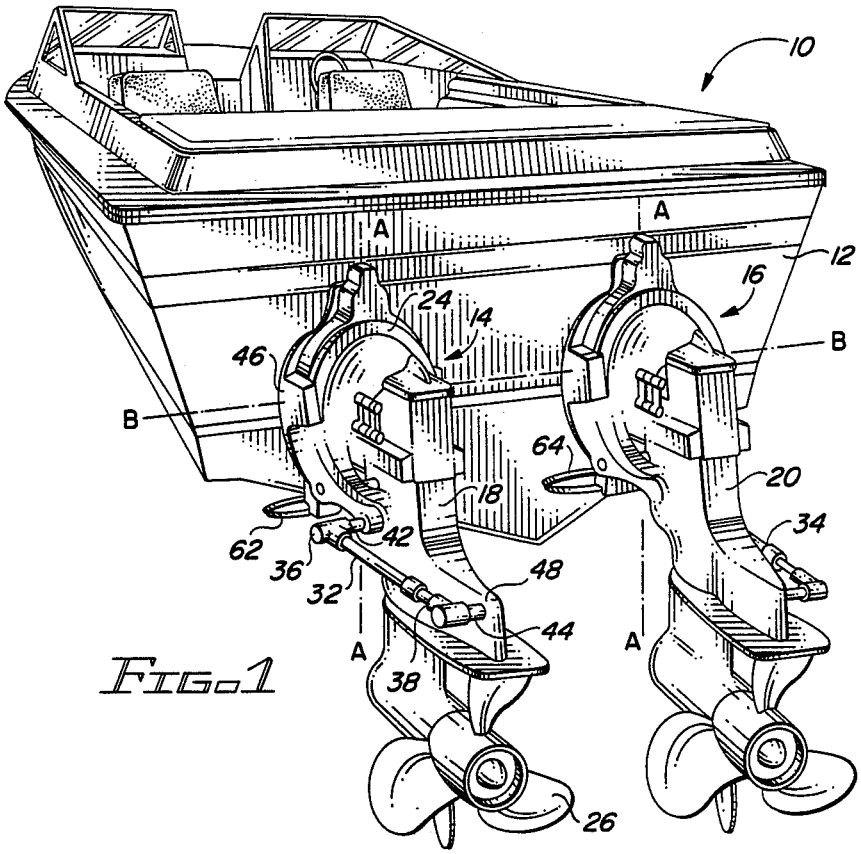
FIG. 1 is a perspective view of the stern of a boat having two tiltable propulsion drives, such as stern drives, mounted on the exterior of the boat transom.
Figure 2:
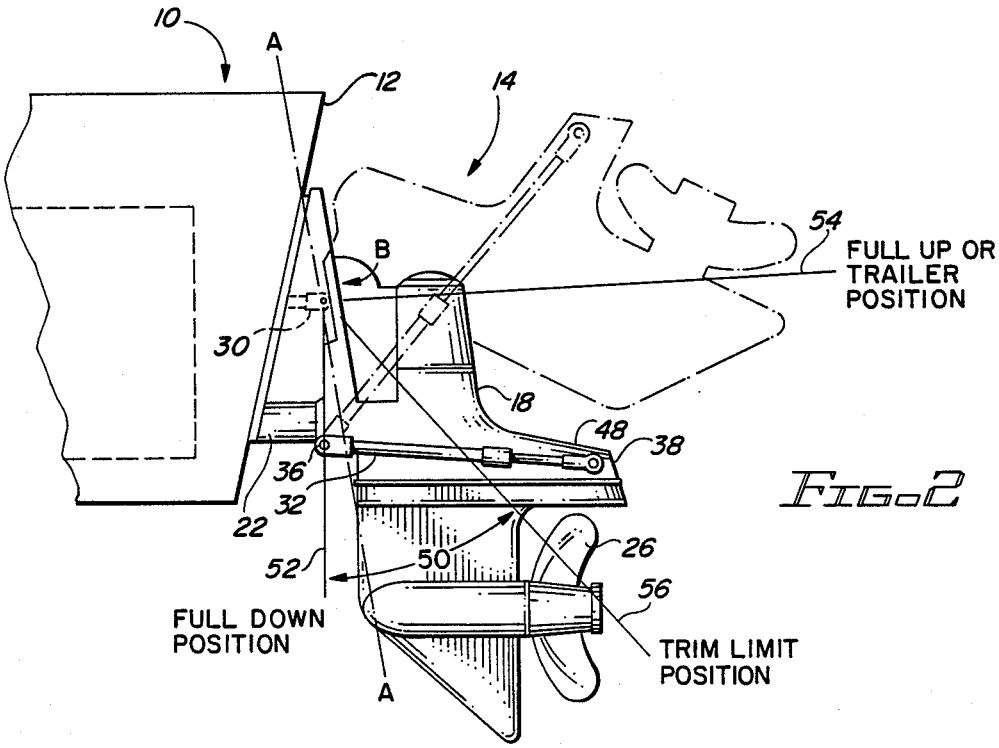
FIG. 2 is a side elevational view of the boat stern and port drive of FIG. 1, showing the drive in full down position and also showing it, in phantom lines, tilted to full up or trailer position.

FIGS. 1 and 2 show a boat 10 having a transom 12 on which is mounted a pair of stern drives 14 and 16 respectively. The drives may take the form of outboard motors or other drives which are similar to each other in construction, mode of operation and certain associated components, and, therefore, only port drive 14 is hereinafter described in detail.

Each of the drives 14,16 include a corresponding drive unit 18,20 connected to the transom 12 through respective transom brackets 22. The drive 14 includes a gimbal ring 24 which pivotally supports the drive unit 18 about a vertical axis A—A for steering and about a horizontal axis B—B for trimming. The drive unit 18 includes a propeller 26 which is driven by an engine inside boat 10 by means of a suitable drive train (not shown), which extends through transom bracket 22 and through drive unit 18. A flexible coupling or a universal joint 30, note FIG. 2, permits the drive unit 18 to move during steering and trimming.

It is to be understood that drive unit 18 is pivotable to port, left, and starboard, right, about axis A—A (FIG. 2) for steering purposes by means of a suitable steering linkage (not shown). Drive unit 18 is also pivotable or tiltable through trim angles in a vertical direction about axis B—B (FIG. 1) for trim and tilt purposes.

Figure 6:
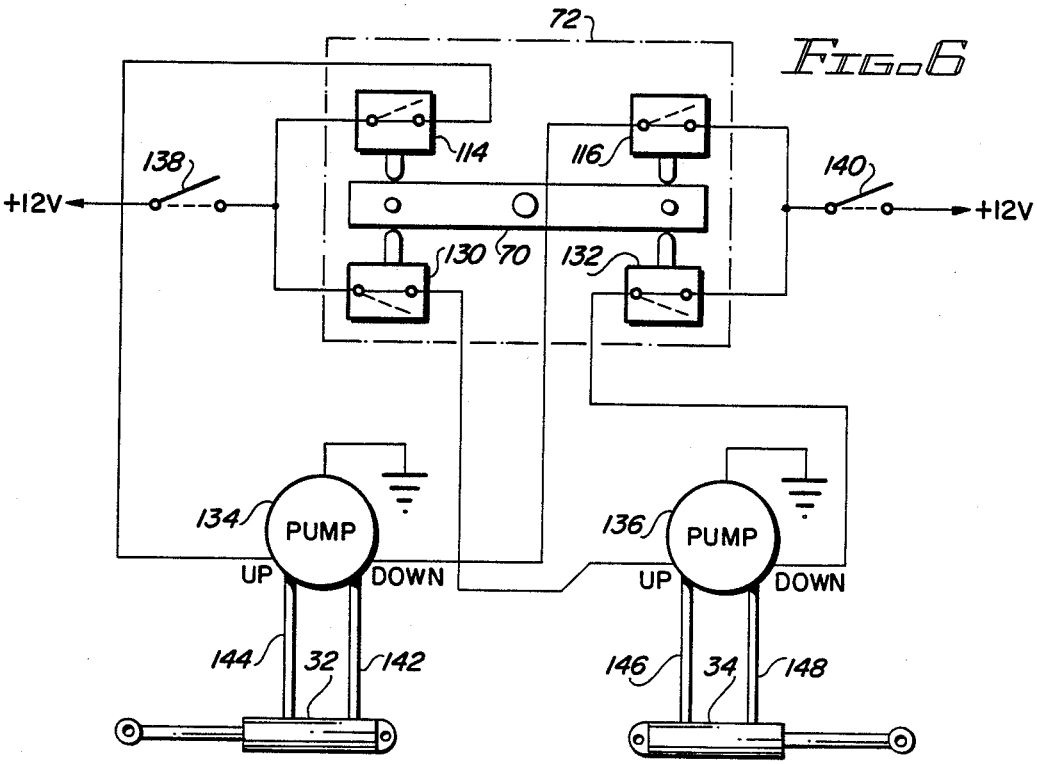
FIG. 6 is a schematic diagram of an electrical circuit for implementing the present invention using the mechanism of FIG. 3.

As FIG. 1 shows, the drive units 18 and 20 are not mechanically coupled and are therefore capable of being trimmed independently of each other. Drive units 18 and 20 are independently tiltable and trimmable vertically by means of a pair of extendable and retractable trim cylinders 32 and 34, which are independently operable and which may take the form of hydraulically driven cylinders of a type well known in the art. Each of the cylinders 32, 34 is connected to a corresponding reversible hydraulic pump with each pump being driven by a reversible direct current (DC) electric motor. The pump and motor form an electro-hydraulic actuator of a type well known in the art. Such actuators are indicated in the electric control system diagrams of FIGS. 4, 6 and 7.

The cylinder 32 has one end pivotally connected by pivot means 36 to transom bracket 22 through projecting arm 42. An extending piston rod 32A has its distal end 38 pivotably connected to the housing 48 of drive unit 18 through a projecting arm 44. When the trim cylinders 32 and 34 are fully retracted, drive unit 18 assumes the full down position shown in FIGS. 1 and 2 and designated by the full down position line 52 in FIG. 2. When the trim cylinders 32 and 34 are fully extended, drive units 18 and 20 assume the full up or trailer position shown in phantom lines in FIG. 2 and designated by the full up position in FIG. 2. The cylinders 32 and 34 are operable to tilt or pivot drive unit 18 to full down or full up position or to any position therebetween, including trim positions within a trim angle or trim range 50 between down line 52 and a trim limit position line designated 56 in FIG. 2. The trim angle 50 is the range within which drive unit 18 is typically positioned to effect trimming while boat 10 is running. The trim limit position line 56 is determined by the location, positioning or setting of a trim limit switch for drives 14, 16.

It is to be understood that drive 16, which as FIGS. 1 and 2 show, is provided with a trim cylinder 34, is also positionable in the same manner as drive 14.

Figure 3:
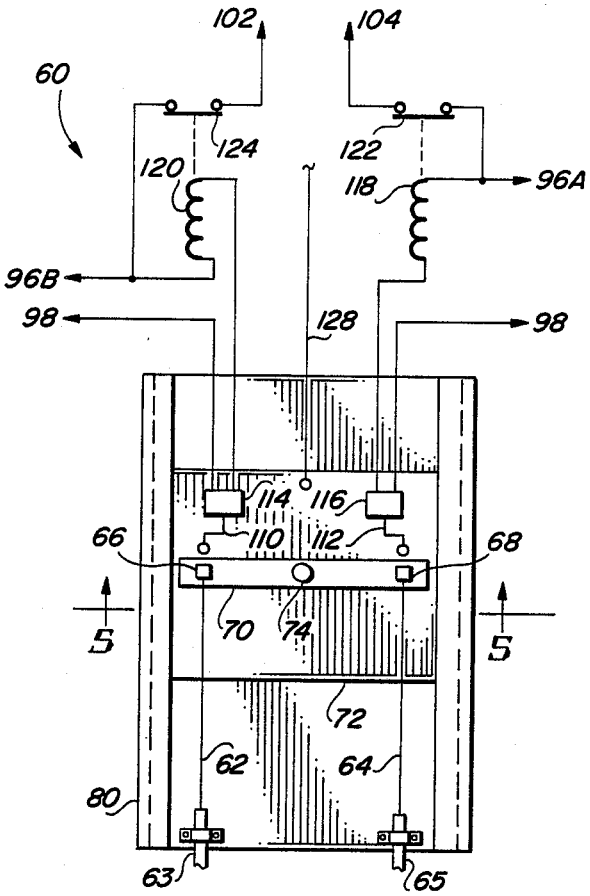
FIG. 3 is a plan view of one form of control mechanism for the joint or automatic individual trimming of the drives of FIGS. 1 and 2.
Figure 4:
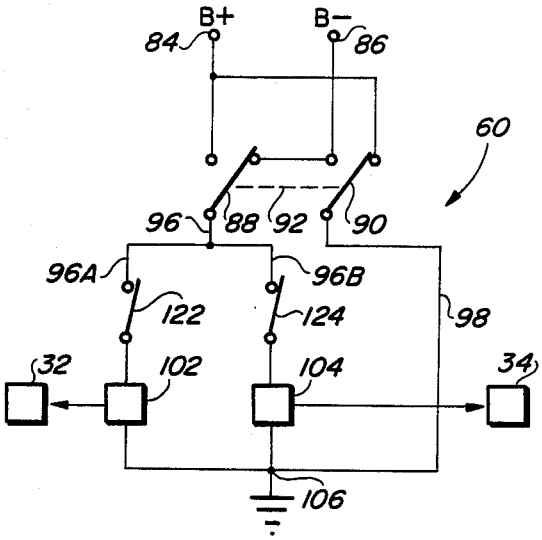
FIG. 4 is one form of control circuit useful in conjunction with the control mechanism of FIG. 3.

In one embodiment, the pair of trim cylinders 32 and 34 for drive units 18, 20 are operated by an electrical actuator system 60, shown in FIGS. 3 and 4. The system of FIGS. 3 and 4 is shown for illustration as an aid to an understanding of the present invention and is a highly simplified combined mechanical and electrical implementation. Actuator system 60 includes a pair of lines 62 and 64 which act as detectors to sense the trim angle of the drives jointly as well as individually and to provide a signal and create conditions for effecting corrective action which will return the drives to the desired orientation of equal trim.

Figure 5:
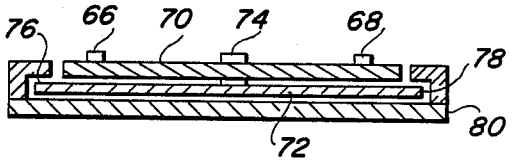
FIG. 5 is a cross-section taken along lines 5—5 of FIG. 3.

Each of the two lines 62,64 is essentially inextensible so as to give proper readings regardless of temperature, usage, age, etc. The lines are preferably slidingly supported in circumferential housings 63, 65 as is well known in the art for increased reliability of performance. Each line is coupled at a first end to its associated drive unit 18,20, with line 62 coupled to drive unit 18 and line 64 coupled to drive unit 20. At its second end, each line is connected or coupled to opposite ends 66, 68 of a pivot arm 70. The pivot arm is mounted on a slide block 72 through a pivot pin 74 for concurrent sliding and rotational movement. The slide block is secured in edge slots 76 and 78 of a fixed base plate 80 best seen in FIG. 5 as a cross-section at lines 5—5. This arrangement of parts of the control system is such that when the drives are jointly raised equally, the lines 62 and 64 will pull each end of the pivot arm equally thus causing arm 70 to move in a sliding motion without rotation, i.e., the block 72 will slide but the arm 70 will not rotate. When the drives are jointly lowered equally, the lines 62 and 64 will push the pivot arm equally. This action will simultaneously push the slide block 72 within the fixed slots. During such movements, the pivot arm 70 will remain perpendicular to the direction of movement of the slide block and pivot arm so long as the detected movement of the drives is equal and the drives remain at an equal trim angle, even though that trim angle is varying.

In the form of the invention illustrated in FIGS. 3–4, a source of electrical potential is coupled to terminals 84,86. Each terminal 84,86 is coupled mechanically and electrically to a pair of three-position actuator switches 88 and 90 which are ganged together to effectively constitute an operator controlled lever 92. This arrangement allows for concurrent movement of the switches 88 and 90 and for the concurrent application and removal of electrical power to the trimming mechanisms by a single throw lever at the control of an operator. The switches are movable from a center or off position to either raise or lower the trim drives. When an operator moves the trim control lever 92 counterclockwise or to the left as seen in FIG. 4, both switches 88 and 90 are closed to apply power via lines 96 and 98 to both trim drive controllers 102,104 of a first polarity. The trim drive controllers 102,104 may be electrically driven hydraulic pumps for controlling hydraulic pressure applied to hydraulic drive cylinders 32,34 to perform the desired angular adjustments to the drive units 18,20.

In the alternative, an operator may move the lever arm 92 clockwise or to the right as viewed in FIG. 4 thus applying power of a reverse polarity to controllers 102,104. This will cause the hydraulic pumps to provide pressure to operate cylinders 32,34 in a reverse direction. Thus, the lever 92 controls the actuation of the cylinders 32,34 to control the tilt of drive units 18,20.

These modes of operation occur under the control of an operator so long as the drives remain at the desired same equal trim orientation, the lines 62 and 64 are equally extended or retracted, and the pivot arm remains perpendicular to the edge slots and the direction of slide plate movement.

At times when the drives are being moved to varying trim orientations, the cables should move forwardly or rearwardly to push or pull the pivot arm, and consequently the slide block, equally with respect to the base plate. When, however, the desired equal trim orientation of the two drives is lost during the normal trimming operation, the lines 62 and 64 will move unequally and move one or the other end 66 or 68 of the pivot arm 70 more than the other. When this occurs, the pivot arm will contact one or the other of fingers 110 or 112 and trip an associated microswitch 114 or 116. This action will energize one of the associated solenoids 118 or 120 and open its contact 122 or 124. This opens one of the lines 96A or 96B, to terminate power to the associated trim drive controllers and trim cylinders while allowing power to continue being applied to the trim drive controller of the unopened line. The switches 114 and 116 are preferably adjustable on the base plate with respect to the pivot arm for adjustment of the system.

By way of example, during the upward trimming with the lever 92 and switches 88 and 90 moved to the left or counterclockwise as seen in FIG. 4, if the right drive unit 20 moves upwardly more than the left, the right end of the pivot arm will move downwardly and the left end will move upwardly to contact left finger 110 to activate the left switch 114. This action will energize solenoid 120 and open contact 124. This will open line 96B to the right trim drive controller to remove power from the right trim cylinder, retaining the right drive in a fixed orientation while power continues to be provided to the left trim drive controller and trim cylinder to raise the left drive unit 18 until it reaches the orientation of the right drive unit 20 and equal trim is once again restored. Throughout these various movements or manual trim varying and automatic trim equalization, cable 128 is attached to the slide plate for movement therewith. At its other end, the cable couples with a single indicator visible to the operator for viewing the trim angle of the drives. Since both drives are trimmed to the same angle, the present invention obviates the need for dual indicators.

In association with this movement, the pivot arm will move back to be perpendicular to the direction of movement of the slide block, removing the left end of the pivot arm from its contact with finger 110 so that both lines 96A and 96B may continue the powering of both trim cylinders and moving the drives under the control of an operator. If the left drive were to move upwardly more rapidly than the right, the action described above would be the same but merely reversed. Further, it will be understood that the movement of automatic trimming for the opposite or downward direction works just the opposite as described above. These alternate automatic trimming modes of operation can be readily understood by one skilled in the electrical arts after reviewing the one mode of trimming as described in detail above.

The above description has been given with respect to an electric motor which does not require relative reversal of field and armature windings for reverse operation. For systems using series wound direct current (DC) motors, reference is now made to FIG. 6. In this form, the additional switches 130,132 are positioned adjacent pivot arm 70 on the side opposite switches 114,116. All the switches 114,116 and 130,132 are attached to sliding block assembly 72. One terminal of each of the switches 114,130 is connected in parallel to a positive voltage source indicated as +12 v (for battery voltage) through a normally open "UP" trim switch 138. Similarly, one terminal of each of the switches 116,132 is connected in parallel to the positive voltage source through a normally open "DOWN" trim switch 140. A second terminal of switch 114 is connected to an "UP" terminal of reversible electro-hydraulic actuator 134 while a second terminal of switch 116 is connected to a "DOWN" terminal of actuator 134. Similarly, a second terminal of switch 130 is connected to an "UP" terminal of electro-hydraulic actuator 136 while a second terminal of switch 132 is connected to a "DOWN" terminal of actuator 136. The actuators 134,136 comprise series wound, reversible DC motors coupled to drive reversible hydraulic pumps, all of a type well known in the art. The actuators 134,136 pump hydraulic fluid via lines 142,144 and 146,148 to respective ones of the double acting hydraulic trim cylinders 32,34.

In operation, if the trim angle between the two drives is unbalanced, the arm 70 will pivot. Assuming that the switch 140 is closed so that the drives are being lowered, a clockwise rotation of arm 70 will open the switch 132, a normally closed switch, thereby removing positive potential from the "DOWN" terminal of actuator 136. Power will continue to be applied to the "DOWN" terminal of actuator 134 causing the associated out drive to continue moving. When the drive trim angles are equalized, the pivot arm 70 will have rotated back to its normal position allowing switch 132 to close so that power is again applied to both actuators 134,136. The same operation occurs for "UP" movement of the drives except that power is applied through switch 138 to the "UP" terminals of actuators 134,136.

Figure 7:
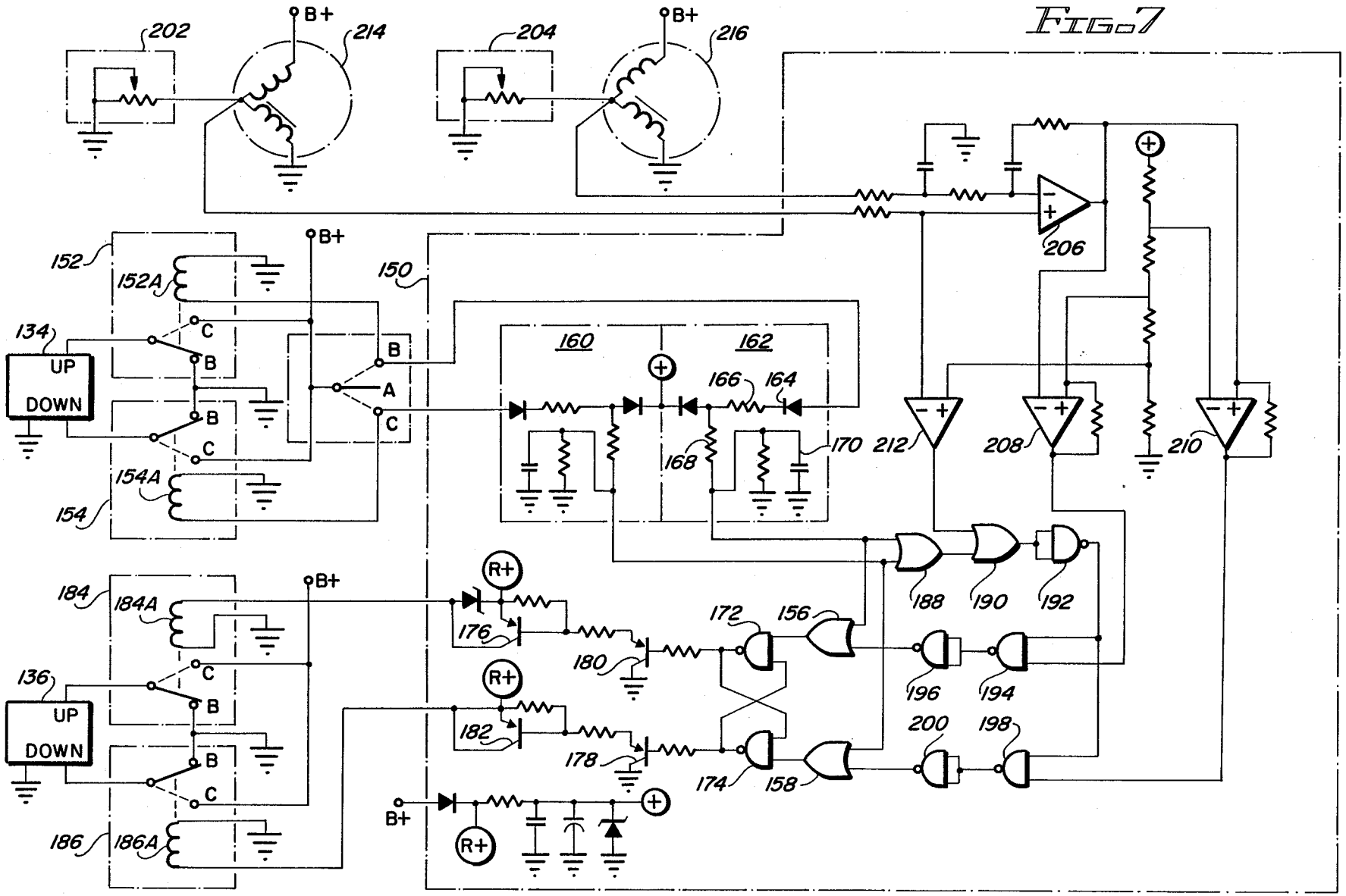
FIG. 7 is another form of the present invention for electronically controlling trim position of multiple stern drives.

Turning now to FIG. 7, there is shown a preferred embodiment of the present invention for automatically adjusting the trim angle of each of a pair of propeller drive units. The illustrative electronic implementation distinguishes between commands for gross tilt adjustments, such as might occur for lifting the drive units out of the water, and fine adjustments for establishing a specific trim angle. Positioning of the drive units 18 and 20 is again controlled by hydraulic cylinders 32,34 driven by electrically powered hydraulic actuators 134,136 of a type well known in the art. One of the actuators, e.g., actuator 134 is considered to be the master actuator while the other actuator 136 is considered to be a slave actuator.

Each of the actuators 134,136 is actuated by a trim switch 150 similar to switch 92 of FIG. 4. Moving the switch lever 150A to contact terminals 150B or 150C determines the direction of tilt or trim adjustment, i.e., moving the drive units 18,20 up or down. When lever 150A is moved to contact terminal 150B, power is applied to relay coil 152A actuating relay 152 to effect movement of relay arm 152B into contact with terminal 152C to apply positive excitation to the "UP" terminal of actuator 134 to cause the drive unit 18 to be driven in an "UP" direction, i.e., to raise the unit 18. Similarly, if lever arm 150A is moved into contact with terminal 150C, power is applied to relay coil 154A of relay 154 to affect movement of relay arm 154B into contact with terminal 154C to apply positive excitation to the "DOWN" terminal of actuator 134 to cause the drive unit 18 to be driven in a "DOWN" direction, i.e., to lower the unit 18.

Clearly, in order to maintain a common trim angle of both drive units 18,20, actuator 136 must be energized at the same time and in the same manner as actuator 134. This is achieved first by sensing the operation of switch 150 with a pair of logical OR gates 156,158. The terminals 150B, 150C are electrically connected through identical signal conditioning circuits 160,162 to respective first input terminals of gates 156,158. Circuits 160,162 each include a steering diode 164, voltage dropping resistors 166,168 and a capacitor-resistor shunt filter 170.

Output terminals of OR gates 156,158 are connected to corresponding first input terminals of logical NAND gates 172,174 respectively. The NAND gates 172,174 are connected to prevent simultaneous activation by cross-coupling each of their respective output terminals to second input terminals of the other of the gates 172,174. The output terminals of gates 172,174 are also connected respectively to base terminals of drive transistors 176,178. The transistors 176,178 are coupled to corresponding power transistors 180,182. The power transistors 180,182 couple power to relay coils 184A, 186A which control the position of relay arms 184B,186B in relays 184,186. If relay coil 184A is powered, arm 184B moves into contact with terminal 184C applying positive potential to the "UP" terminal of tilt drive pump unit 136. Conversely, if coil 186A is powered, arm 186B moves into contact with terminal 186C applying positive potential to the "DOWN" terminal of tilt drive actuator 136. Thus, if lever 150A is moved into contact with terminal 150B, positive excitation is applied to the UP terminal of actuator 134. This positive potential is coupled through signal conditioning circuit 162 to one input terminal of OR gate 156 causing it to generate a logical 1 output signal. This logic signal is inverted by NAND gate 172 and coupled to transistor 176 which is thereby gated into conduction. Transistor 176 gates transistor 180 into conduction thereby applying power to relay coil 184A to move arm 184B and apply positive potential to "UP" terminal of actuator 136. Thus, both drive units are activated by movement of lever arm 150A.

During the above described manual operation, the automatic trim function is preferably inhibited. The logical signals developed by signal conditioning circuits 160,162 are coupled through an OR gate 188 to one input terminal of an OR gate 190. The output terminal of gate 190 is connected to a NAND gate 192 which inverts any signal generated by gate 190. Thus, if lever arm 150A is in either the "UP" or "DOWN" position, the OR gates 188,190 will provide logical 1 signals to NAND gate 192 which will be inverted to logical 0's. The signals developed by NAND gate 192 are coupled to one input terminal of a NAND gate 194 forcing the output signal developed by gate 194 to a logical 1 anytime lever arm 150A is in other than a neutral position. The signal developed by gate 194 is inverted by a NAND gate 196 and applied to a second input terminal of OR gate 156. Similarly, NAND gate 198 receives the signal from gate 192 and is forced to a logical 1 output state. NAND gate 200 inverts the signal from gate 198 for application to a second input terminal of OR gate 158. Thus, whenever the lever arm 150A is in either a manual "UP" or "DOWN" position, the NAND gates 194, 198 are forced to logical 1 output states. As will become apparent, this action inhibits automatic trimming.

During operation of the marine vessel, it is desirable to provide automatic trimming of drive units. The embodiment of FIG. 7 accomplishes this result by sensing the position of the drive units 18,20 using the aforementioned cables 62,64 which are connected to respective potentiometers 202,204. Alternately, the potentiometers 202,204 could be mounted directly to the drive units and eliminate cables 62,64. The potentiometers 202,204 provide for control of tilt angle meters 214,216 which in turn provide an indication of the meters 214,216 which in turn provide an indication of the actual tilt angle of drive units 18,20. Coupled to the potentiometers 202,204 is a differential operational amplifier 206. Amplifier 206 is biased so as to provide an output signal which swings high or low relative to any angular mismatch of the drive units 18,20. The output terminal of amplifier 206 is connected to the inverting input terminal of an amplifier 208 and a non-inverting input terminal of an amplifier 210. The output terminals of amplifiers 208,210 are connected respectively to second input terminals of NAND gates 194,198. If gates 194,198 are not inhibited by gate 192 (lever arm 150A in a neutral position), the signals from amplifiers 208,210 will activate one or the other of the gates 194,198 thereby operating relays 184,186 controlling actuator 136. Thus, actuator 136 will adjust or trim the tilt angle of drive unit 20 to minimize any difference between its tilt angle and that of drive unit 18. By treating the drive unit 18 as a master and the unit 20 as a slave, the circuit of FIG. 7 automatically maintains common tilt angles for both units 18,20. It should also be noted that the signal from master trim sensor potentiometer 202 is coupled to a comparator 212. When the potentiometer 202 signal reaches a value indicating that the drive 18 is entering the tilt or "trailering" range, automatic trim is inhibited by a change of output signal state of comparator 212. The drives 18,20 are then only manually controllable to allow positioning for trailering. The signal from comparator 212 is applied to a second input terminal of OR gate 190 to effect the inhibit function.

The present invention is equally applicable to a wide variety of multiple drive unit boats, both commerical and pleasure, whether stern drives, surface drives, outboard motors, trim tabs, etc. While it has been described with reference to a dual drive unit system, it is also applicable to systems having more than two drives. By using one drive unit as a master as explained with regard to FIG. 7, any number of drive units can be trimmed against the master by the use of additional circuits equivalent to those illustrated.

While the present invention has been described with reference to a particular embodiment, it is not intended to be so limited, but it is intended to be interpreted within the spirit and scope of the appended claims.

We claim:

1. A system to independently equalize the angular drive position of multiple drives mounted on a boat wherein the drives are both jointly and independently movable through a plurality of angular positions, the system including:

(a) independently controllable power actuating means coupled to each of the drives for independently varying the angular position of each drive;

(b) manual means for energizing one of said power actuating means for establishing a desired angular drive position for a corresponding one of said drives;

(c) means for sensing energization and direction of movement of said one of said power actuating means and for energizing others of said power actuating means for establishing conjoint movement of other corresponding ones of said drives;

(d) means coupled to each of the drives for providing an indication of the angular position of each drive; and (e) means responsive to said indication providing means for automatically controlling the energization of said others of said power actuating means for maintaining said other corresponding ones of said drives at a common angular position with said corresponding one of said drives, said indication responsive means comprising electronic means responsive to any difference between the angular position of said one of said drives and said others of said drives for energizing said others of said power actuating means operatively associated with said other ones of said drives for varying the tilt angle of said other ones of said drives into alignment with said one of said drives.

2. The system of claim 1 and including means for inhibiting said indication responsive means when the drives are energized by said manual means.

3. The system of claim 2 wherein said position indication means comprises means responsive to the angular position of each drive for providing electrical signals representative thereof, said indication responsive means including means for comparing said electrical signals and providing a signal representative of the angular difference therebetween.

4. The system of claim 3 and including means for converting said angular difference signal to a logical signal representative of the direction of angular difference of a selected one of the drives with respect to the other of the drives, said logical signal being applied to said power actuating means of said one of the drives for varying its angular position in a direction to minimize the angular difference between the drives.

5. The system of claim 4 wherein said inhibiting means comprises means for sensing actuation of said manual means and for inhibiting said logical signal in response thereto.

6. An automatic trim system for dual outboard drive units of a boat, the drive units being continuously and independently tiltable between full up and full down angular positions by hydraulic cylinders coupled between each drive unit and the boat, the cylinders being controlled by independent electrically powered hydraulic actuators, one of the drives being designated as a master unit and the other being designated as a slave unit, the system comprising:

first and second cables each having one end connected to a respective one of the drive units whereby variations in angular tilt of a drive unit changes the position of a second end of a corresponding cable;

first and second electrical variation means each connected to a corresponding one of the second ends of said cables for providing electrical signals representative of the position of the second ends of said cables and thereby the angular tilt of a corresponding drive unit;

differential comparator means connected to receive said electrical signals for providing difference signals representative of the polarity of difference between said position representative electrical signals; and logic means responsive to said difference signals for energizing a one of the actuators operatively associated with the slave unit for varying its tilt angle position in a direction to minimize the angular difference between it and the master drive unit.

7. The system of claim 6 and including a manual control means for simultaneously energizing both of the pumps for effecting tilting of both drive units in a common direction.

8. The system of claim 7 and including means responsive to said manual control means for inhibiting application of said difference signal for varying the tilt angle when said manual means is actuated.

* * * * *